US006181124B1

(12) United States Patent
McQueen

(10) Patent No.: US 6,181,124 B1
(45) Date of Patent: Jan. 30, 2001

(54) EDDY CURRENT REDUCING SYSTEM

(76) Inventor: Clarence W. McQueen, P.O. Box 781, Hailey, ID (US) 83333

( * ) Notice: Under 35 U.S.C. 154(b), the term of this patent shall be extended for 0 days.

(21) Appl. No.: 09/496,468

(22) Filed: Feb. 2, 2000

(51) Int. Cl.[7] ..... H01F 40/14
(52) U.S. Cl. ..... 323/356
(58) Field of Search ..... 323/356, 357

(56) References Cited

U.S. PATENT DOCUMENTS 4,659,981 * 4/1987 Lumsden ..... 323/356
4,887,028 * 12/1989 Voisine et al. ..... 323/356
5,150,046 * 9/1992 Lim ..... 323/356

* cited by examiner

*Primary Examiner*—Jeffrey Sterrett

(57) ABSTRACT

Eddy currents are produced by a changing magnetic field acting upon free electric charges in the ferromagnetic core. When the free electric charges are removed from the core eddy currents will be reduced. When an excess of free electric charges are added to the core , the magnetic field energy is spread over many more electric charges. Then the magnitude of movement of each electric charge will be reduced and the eddy currents will be reduced. The reduction of eddy currents will reduce heat and the energy losses related there to. This has applications on all alternating current inductive devices.

4 Claims, 1 Drawing Sheet

EDDY CURRENT REDUCING SYSTEM

CROSS REFERENCE TO RELATED APPLICATIONS

This eddy current reducing system utilizes well known parts and principals. The application of these parts to reduce eddy currents is, to the best of my knowledge, completely new.

FEDERAL SPONSORED R&D

No federal R&D funds were received.

REFERENCE TO MICROFICHE APPENDIX

Microfiche appendix is not required.

BACKGROUND OF THE INVENTION

This invention relates to the reduction of eddy currents by removing or adding electric charges to the ferromagnetic core of an electromagnetic induction device. The eddy currents are reduced by reducing free electric charges, in the core, that are acted upon by a varying magnetic field. Eddy currents are reduced, to a lesser extent, by adding electric charges thereby dispersing the magnetic field energy over a greater number of electric charges reducing the magnitude of each electric charge movement.

SUMMARY OF THE INVENTION

It is the object of my invention to provide a system that will reduce electromagnetic core energy loss resulting from eddy currents by reducing or by increasing the quantity of free electric charges within the core.

It is another object of my invention to eliminate the need to manufacture ferromagnetic cores from thin sheet stock thereby reducing the labor needed to produce said cores.

The aforementioned and other objects of this invention are achieved by the utilization of a rectifier or other direct current source to produce an electrical potential in the ferromagnetic core. This is accomplished by modifying the ferromagnetic core if necessary to assure that all parts of the core are electrically connected and by connecting a rectifier to the core and also to a suitable alternating current source. The core can also be connected directly to a suitable direct current power source. These connections will produce an electric potential in the core when said system is functioning. The magnitude of the electric potential will be determined by the voltage of the power source.

DESCRIPTION OF THE PREFERRED EMBODIMENT

Figure 1:
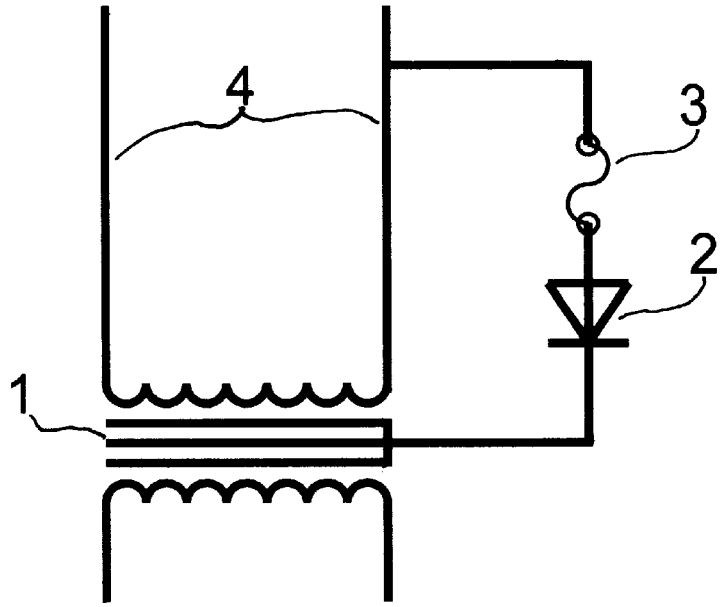
FIG. 1—This is the most practical version and utilizes a rectifier connected from an alternating current power source to the ferromagnetic core. The ferromagnetic core is, if necessary, modified so that all parts are electrically connected and the core is insulated from the ground or other conductors.

Referring now to FIG. 1. This is the most practical unit. Part 1 is the electromagnetic inductor modified as necessary to assure that the ferromagnetic core is insulated from ground and from other conductors and that each part of the core is electrically connected Part 2 is a rectifier connected to the core and to an alternating current power source. Part 3 is an over current interrupter such as, a fuse link, a fuse or a circuit breaker. The over current interrupter can be connected between the rectifier and the core or between the rectifier and the power source. Part 4 is the power source to the inductive device or it can be a seperate power source.

DESCRIPTION OF OTHER EMBODIMENTS

Figure 2:
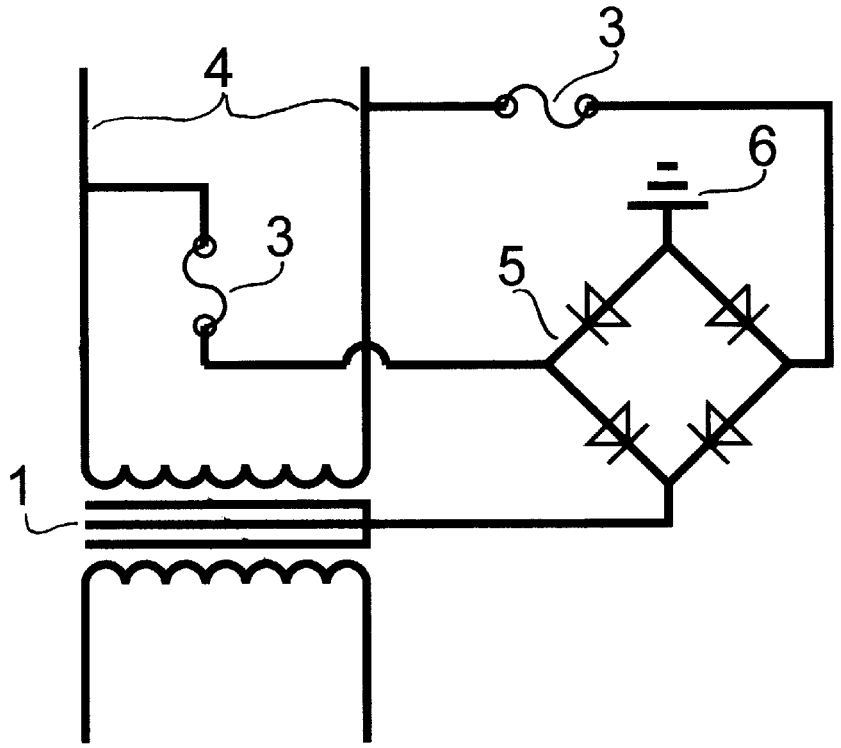
FIG. 2—This system utilizes a bridge rectifier connected to both alternating current lines from the power source and to the bridge rectifier. One of the bridge rectifiers direct current connectors is connected to the ferromagnetic core and the other is connected to ground. The ferromagnetic core is, if necessary, modified so that all parts are electrically connected and the core is insulated from the ground or other conductors.

Referring now to FIG. 2. Part 1 is the electromagnetic inductive unit with the core modified, if necessary, to assure that all parts of the core is electrically connected and the core is insulated from the ground and any conductor. Part 5 is a bridge rectifier with the alternating current connectors connected to the alternating current power lines that supply current to the inductive device or they are a seperate alternating power source. One of the direct current connectors is connected to the inductor core and the other connector is connected to ground. Part 3 is an over current interrupter (s) such as a fuse link, a fuse or a circuit breaker. These are safety units and should be connected between the bridge rectifier and the power source. Part 4 is the alternating current source and may be either the power source for the inductive device or a separate power source. Part 6 is a ground needed to complete the direct current circuit.

TESTS

Equipment

A 220 volt primary with a 110 volt secondary, 100 watt transformer was used. A weld bead was laid across the top and the bottom of the core to obtain an electrical connection between each layer of the core. The secondary conductors were cut off and insulated to eliminate any electrical connection with the core, the ground or any other conductor. A short conductor was connected to one of the primaries with a male spade connector on the other end. Another short conductor was connected to the core with a male spade connector on the other end.

A short conductor was connected to each end of a 3 amp 400 PIV rectifier and one end each of these conductors were fitted with female spade connectors.

A two quart insulated plastic bucket was prepared.

Five pints of mineral oil was obtained.

One emersion thermometer was available.

Test Set Up

The above noted transformer was placed in the insulated bucket and two pints of mineral oil was added to completely cover the transformer. One end of the conductor with a spade connector is connected to the primary coil. One end of the other conductor with a spade connection was connected to the core. These were placed outside of the insulated bucket. The emersion thermometer was placed in the bucket without touching either the core or any conductor.

A series of three tests were conducted on each of the three conditions, starting on the fourth of January 2000 and ending on the fourteenth of January 2000. Each test was considered confirmed by similar results obtained on the other two tests.

Test Results

Control Test

| TIME | DEG. C | INCREASE | CUMULATIVE |
|---|---|---|---|
| 7:00 AM | 13.7 | 0 | 0 |
| 7:15 AM | 14.0 | .3 | .3 |
| 7:30 AM | 14.8 | .8 | 1.1 |
| 7:45 AM | 16.0 | 1.2 | 2.3 |
| 8:00 AM | 17.4 | 1.4 | 3.7 |
| 8:15 AM | 18.5 | 1.1 | 4.8 |
| 8:30 AM | 19.5 | 1.0 | 5.8 |
| 8:45 AM | 20.5 | 1.0 | 6.8 |
| 9:00 AM | 21.5 | 1.0 | 7.8 |

Test A

The rectifier is connected to the two conductors in such a way as to draw off the negative electric charges and produce a positive potential in the core.

| | | | |
|---|---|---|---|
| 8:00 AM | 15.2 | 0 | 0 |
| 8:15 AM | 15.3 | .1 | .1 |
| 8:30 AM | 15.5 | .2 | .3 |
| 8:45 AM | 16.4 | .9 | 1.2 |
| 9:00 AM | 17.4 | 1.0 | 2.2 |
| 9:15 AM | 18.5 | 1.1 | 3.3 |
| 9:30 AM | 19.4 | .9 | 4.2 |
| 9:45 AM | 20.3 | .9 | 5.1 |
| 10:00 AM | 21.2 | .9 | 6.0 |

Test B

The rectifier is reversed to produce a negative potential in the core.

| | | | |
|---|---|---|---|
| 8:00 AM | 14.0 | 0 | 0 |
| 8:15 AM | 14.1 | .1 | .1 |
| 8:30 AM | 14.3 | .2 | .3 |
| 8:45 AM | 15.3 | 1.0 | 1.3 |
| 9:00 AM | 16.5 | 1.2 | 2.5 |
| 9:15 AM | 17.7 | 1.2 | 3.7 |

-continued

| | | | |
|---|---|---|---|
| 9:30 AM | 18.7 | 1.0 | 4.7 |
| 9:45 AM | 19.6 | .9 | 5.6 |
| 10:00 AM | 20.5 | .9 | 6.5 |

A positive potential of 220 volts in the core produced a reduction of 23% in total losses. A negative potential of 220 volts in the core produced a reduction of 17% in total losses. Because eddy currents are only a part of the total losses we can conclude that a positive potential in the core is significantly better than a negative potential. The foregoing asumptions of heat loss are not exactly precise. The tests were to short in duration and longer tests will be conducted.

I claim:

1. An eddy current reducing system comprising a rectifier, connected between an inductor or transformer core and an alternating current power source, either the primary for an inductor or the primary or secondary for a transformer, with said core insulated from the ground or other conductor in such a way as to obtain a relatively high electrical potential on said core.

2. An eddy current reducing system, as in claim 1, with the addition of an over current interrupter connected between the rectifier and the core or between the alternating current power source and the rectifier.

3. An eddy current reducing system comprising a bridge rectifier, with the alternating current connectors connected to an alternating current power source, either the primary for an inductor or the primary or the secondary for a transformer and with one of the direct current connectors connected to a core and with the other direct current connector connected in such a way as to obtain a relatively high electrical potential on said core.

4. An eddy current reducing system, as in claim 3, with over current interrupters connected between the alternating current connectors of the bridge rectifier and the alternating current power source.

* * * * *